US007959366B2

(12) United States Patent
You

(10) Patent No.: US 7,959,366 B2
(45) Date of Patent: Jun. 14, 2011

(54) MOBILE IMAGE FORMING APPARATUS

(75) Inventor: Ho-gun You, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 743 days.

(21) Appl. No.: 11/775,942

(22) Filed: Jul. 11, 2007

(65) Prior Publication Data

US 2008/0025755 A1 Jan. 31, 2008

(30) Foreign Application Priority Data

Jul. 25, 2006 (KR) ..... 10-2006-0070025

(51) Int. Cl.
*B41J 3/36* (2006.01)
*B41J 3/37* (2006.01)
*B41J 3/39* (2006.01)

(52) U.S. Cl. ..... 400/88; 400/693; 347/109

(58) Field of Classification Search ..... 400/88, 400/578, 693, 691; 358/400; 399/104, 108; 347/109

See application file for complete search history.

(56) References Cited

U.S. PATENT DOCUMENTS

| | | | | |
|---|---|---|---|---|
| 5,345,403 | A * | 9/1994 | Ogawa et al. | 361/679.26 |
| 5,423,529 | A * | 6/1995 | Saito et al. | 271/127 |
| 5,917,995 | A * | 6/1999 | Ota | 358/1.12 |
| 6,069,711 | A * | 5/2000 | Iwata | 358/400 |
| 6,752,554 | B1 * | 6/2004 | Brittingham | 400/693 |
| 6,793,301 | B2 * | 9/2004 | Kaburagi | 347/2 |

FOREIGN PATENT DOCUMENTS

| | | |
|---|---|---|
| JP | 6-286266 | 10/1994 |
| JP | 9-123538 | 5/1997 |
| JP | 10-287011 | 10/1998 |

* cited by examiner

*Primary Examiner* — Daniel J Colilla
*Assistant Examiner* — Marissa L Ferguson-Samreth
(74) *Attorney, Agent, or Firm* — Stanzione & Kim, LLP

(57) ABSTRACT

A mobile image forming apparatus forming an image on a media including a main body, a folding part, which is provided to be folded and unfolded via a predetermined rotating shaft, rotating between a closed configuration coupled to the main body and an opened configuration opened from the main body and having a folding transferring path for transferring the media, and an image forming part provided in at least one of the main body and the folding part.

17 Claims, 6 Drawing Sheets

MOBILE IMAGE FORMING APPARATUS

CROSS-REFERENCE TO RELATED APPLICATIONS

This application claims priority from Korean Patent Application No. 10-2006-0070025, filed on Jul. 25, 2006, in the Korean Intellectual Property Office, the disclosure of which is incorporated herein by reference in its entirety.

BACKGROUND OF THE INVENTION

1. Field of the Invention

The present general inventive concept relates to an image forming apparatus, and more particularly, to a mobile image forming apparatus which is easily carried.

2. Description of the Related Art

In general, an image forming apparatus is connected to a host apparatus in which image data is stored to print image data on media according to an output signal applied from the host apparatus. The image forming apparatus is classified into an inkjet type, an electrophotographic type, and a dye sublimation type according to a method and a function in which an image is formed.

As technology has developed, an image forming apparatus coupled to a portable host apparatus is capable of directly transferring and receiving image data. As photo image data shooting technology through a portable digital camera and a cellular phone has been developed and its use has increased rapidly, it is desirable to output the photo image data from the portable digital camera or cellular phone to the image forming apparatus.

Accordingly, a specialty image forming apparatus designed exclusively to output photo image data has been developed. Among these various image forming apparatuses, a dye sublimation type is widely used since the output photo images from the dye sublimation type have a high resolution and are less likely to be deteriorated by moisture in material properties, and thus are able to be maintained for a long time.

However, the size of the conventional specialty image forming apparatus is bulky and awkward, thus causing a user some difficulty if the user attempts to directly output image data while carrying the conventional specialty image forming apparatus.

Furthermore, because the conventional specialty image forming apparatus does not have a media storing part for storing media inside of the main body, the user is required to feed the media manually, which further aggravates the aforementioned difficulty. Likewise, the conventional specialty image forming apparatus is unable to output printed media successively because of the lack of the media storing part.

SUMMARY OF THE INVENTION

It is therefore an aspect of the general inventive concept to provide an image forming apparatus which is easily portable and can feed media automatically.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an mobile image forming apparatus to form an image on a printing medium, comprising a main body, a folding part which is provided to be folded and unfolded with respect to a predetermined rotating shaft rotating between a coupling closed position coupled to the main body and an opened position opened from the main body and has a folding transferring path to transfer the media, and an image forming part provided in at least one of the main body and the folding part.

The main body may comprise a main body transferring path to transfer the media.

The main body transferring path and the folding transferring path may be communicatively provided in the coupling position.

The main body may comprise a media storing part to store the media.

The image forming part may be provided in the folding part, and the image forming part may form an image on the media transferred from the media storing part to the folding transferring path when the folding part is in the opened position.

The rotation shaft may comprise a pick-up roller to apply a friction force to the stored media and to feed the same to the folding transferring path and may be provided in one end part of the media storing part.

The folding part may comprise an opening on one side through which the media can enter or exit, and a transferring unit for transferring the media from the image forming part on which the image may be formed to the opening is provided on the folding transferring path.

The image forming part may form an image on the media manually fed from the opening and transferred to the folding transferring path in the case that the folding part is in the closed position.

The transferring unit may transfer the media from the image forming part on which the image is formed to the main body transferring path.

The main body may comprise a position sensor part detecting whether the folding part is in the opened position or the closed position, and a controller to control the transferring path of the media transferred to the image forming part according to the result detected by the position sensor part.

When the folding part is in the closed position according to the result detected by the position sensor part, the controller may control the image forming part to form an image on the media inputted from the outside through the folding transferring path when an output signal is applied.

The folding part may be provided on one side of the image forming part and may comprise a transferring unit to transfer the media so that the image-formed media can be discharged through the main body transferring path.

The main body may comprise a media storing part to store media, and a pick-up roller to pick up the media of the media storing part, wherein the controller may control the pick-up roller to automatically feed the media stored in the media storing part to the folding part in the case that the folding part is in the opened position according to the result detected by the position sensor part.

The image forming part may comprise a thermal print head (TPH) to apply heat to the media, wherein the controller may control the TPH to be preset at a reference temperature at which the TPH may apply heat to the media and form an image.

The main body may comprise a radio communication part to receive image data from a host apparatus.

The foregoing and/or other aspects and utilities of the present general inventive concept may further be achieved by providing a portable image forming apparatus having a main body having a media storing part to store a printing medium, a folding part having an image forming part to form an image on the printing medium, and a coupling part to couple the main body and the folding part in an open and closed position and to pick up the printing medium to be fed to form the image.

The main body may comprise a path through which the printing medium is fed, and the folding part may comprise another path through with the printing medium is fed.

The path and the another path may be connected when the folding part is in the closed position.

The path and the another path may not be connected when the folding part is in the opened position.

The path and the another path may form a straight line path in the closed position.

The coupling part may comprise a shaft to rotatable couple the main body and the folding part and a pick-up roller having a same rotating axis as the shaft to pick up the printing medium.

The coupling part may feed an externally input printing medium toward the image forming part.

The main body and the folding part may form a hexahedral shape in the closed position.

The main body may comprise a first portion having a first thickness, a second portion having a second thickness to receive the folding part in the closed position, and the folding part having a third thickness, wherein the first thickness is substantially the same as a sum of the second thickness and the third thickness.

The foregoing and/or other aspects and utilities of the present general inventive concept may further be achieved by providing a method of an image forming apparatus, the method comprising providing a main body, connecting a folding part to the main body such that the folding part and the main body are folded and unfolded with respect to a predetermined rotating shaft rotating between a coupling closed position coupled to the main body and an opened position opened from the main body, providing a folding transferring path to transfer the media, and providing an image forming part in at least one of the main body and the folding part.

The foregoing and/or other aspects and utilities of the present general inventive concept may further be achieved by providing a method of an image forming apparatus, the method comprising storing a printing medium in a main body having a media storing part, forming an image on the printing medium using an image forming part disposed in a folding part, coupling the main body and the folding part in an opened and closed position with a coupling part, and picking up the printing medium to be fed to form an image with the coupling part.

The foregoing and/or other aspects and utilities of the present general inventive concept may further be achieved by providing a main body having a main path and a paper storage part, and a folding part having a path and an image forming part disposed on the folding path, wherein the main body and the folding part are rotatably connected to each other in an opened position where the path is used as an entrance and an exit, and a closed position where the path is used as the entrance and the main path is used as the exit.

The foregoing and/or other aspects and utilities of the present general inventive concept may further be achieved by providing a method of forming an image on a printable media via a portable image forming apparatus, the method comprising manually selecting a body configuration, automatically selecting one of a plurality of predetermined print paths, automatically selecting one of a plurality of predetermined printable media sources, and printing the image on the printable media.

BRIEF DESCRIPTION OF THE DRAWINGS

These and/or other aspects and utilities of the present general inventive concept will become apparent and more readily appreciated from the following description of the exemplary embodiments, taken in conjunction with the accompanying drawings, in which.

DETAILED DESCRIPTION OF THE PREFERRED EMBODIMENTS

Figure 1:
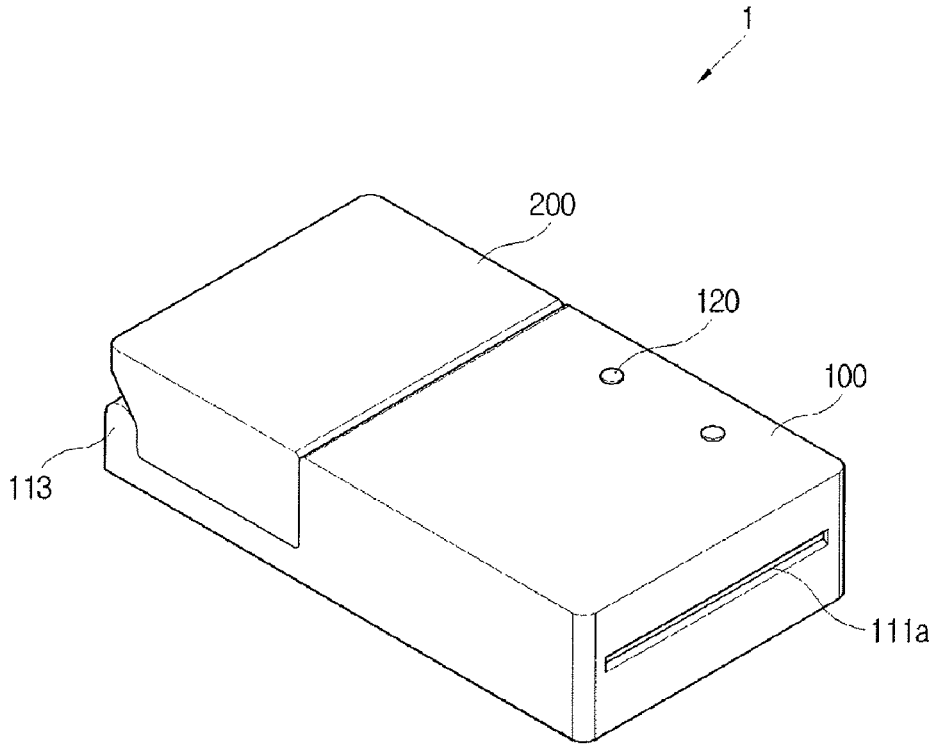
FIG. 1 is a perspective view illustrating a closed configuration of a folding part of an image forming apparatus according to an embodiment of the present general inventive concept.

Reference will now be made in detail to the embodiments of the present general inventive concept, examples of which are illustrated in the accompanying drawings, wherein like reference numerals refer to like elements throughout. The embodiments are described below so as to explain the present general inventive concept by referring to the figures.

The same elements are given the same reference numerals in various embodiments, and they will be typically described in the first embodiment, and will be omitted in the other embodiments as necessary.

An image forming apparatus 1 according to an exemplary embodiment of the present general inventive concept is provided to have a thermal type which forms an image on media 132 having a plural numbers of ink layers responding to heat to realize different colored image.

Figure 2:
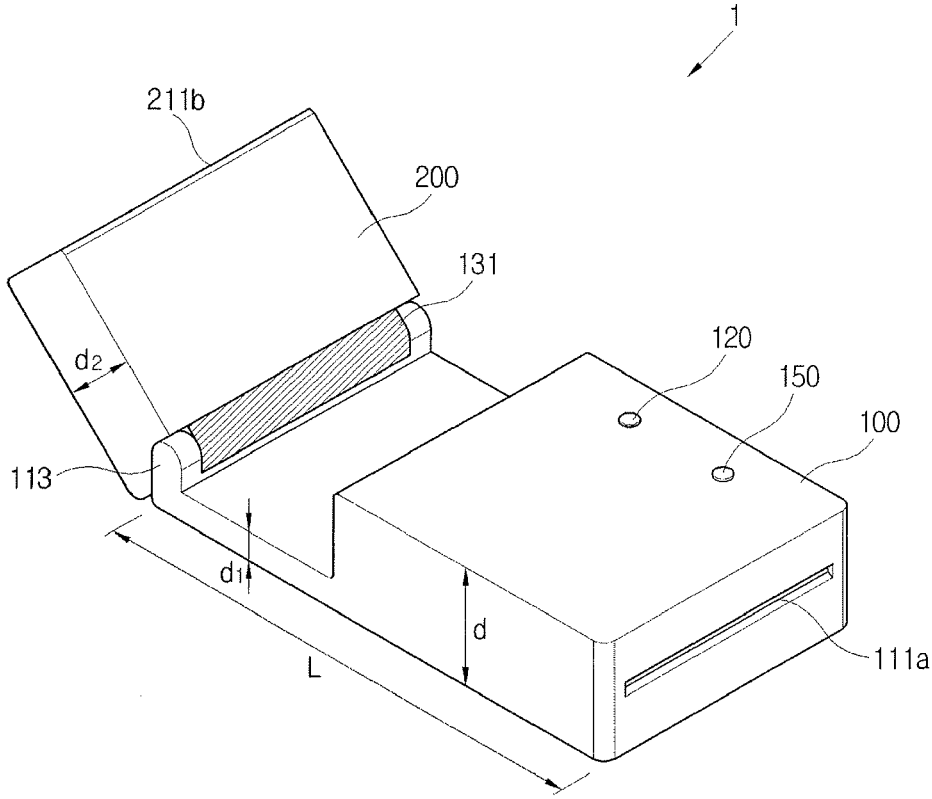
FIG. 2 is a perspective view illustrating an opened configuration of a folding part of an image forming apparatus according to an embodiment of the present general inventive concept.

As illustrated in FIGS. 1 to 3B, the image forming apparatus 1 comprises a main body 100, and a folding part 200 that is capable of being folded and unfolded between a closed configuration wherein the folding part 200 is closed and folded into the main body 100, as illustrated in FIG. 1, and an open configuration wherein the folding part 200 is opened and unfolded away from the main body 100, as illustrated in FIG. 2. The main body 100 and the folding part 200 are provided to form a predetermined shape in a coupled state, which is conducive to carrying the main body 100 and/or storing the main body 100 on a user, such as in a user pocket, for example. As illustrated in FIG. 1, the main body 100 and the folding part 200 are provided to be a rectangular hexahedron when in the closed configuration. To form the predetermined shape, the sum of a thickness d2 of the folding part 200 and a thickness d1 of one side of the main body coupled to the folding part 200 is provided to be equal to a thickness d of the whole main body 100.

Here, the image forming apparatus 1 is provided to have the main body in the shape of a rectangular hexahedron in the closed configuration, but may be provided to have other functional and/or ornamental shapes.

The main body 100 comprises a casing 110 to form a main body transferring path 115 having a pair of openings 111*a* and 111*b* provided so that the media 132 can be fed in and out externally when the folding part 200 is in the closed configuration. The main body 100 further comprises a coupling part 113 provided on one side of the casing 110 to allow rotatable coupling of the folding part 200 and the casing 110 and to receive the folding part 200 in the closed configuration, an inputting part 120 provided on the casing 110 to receive an input signal by a user, a media storing part 130 provided in a lower part of the casing 110 to store the media 132, which include a plurality of media, an opening and closing sensor part 140 to detect whether the folding part 200 is in the opened configuration or the closed configuration, a communication part 150 to receive image data from a host apparatus, and a controller 160 to control the above-described components according to the result detected by the configuration sensor part 140.

The casing 110 protects the internal components from an external shock and the environment including, but not limited to moisture. The casing 110 is desirably provided to have a sufficient durability and a lightweight material that a user can easily carry, such as but not limited to acrylonitrile butadiene styrene (ABS) or polycarbonate (PC). The inside of the casing 110 contains the main body transferring path 115 to transfer the media 132. At opposite end parts of the main body transferring path 115 are the pair of openings 111*a* and 111*b* through which the media 132 can be fed in and out externally and when the folding part 200 is in the closed configuration. Also, the main body transferring path 115 for transferring the fed-in media 132 from the opening 111*a* to the other opening 111*b* may sufficiently accommodate the fed-in media 132 according to the arrangement of the frame and the components in the inside of the main body 100. On the main body transferring path 115, a transfer roller (not illustrated) is provided for transferring the fed-in media 132 to the other opening 111*b* to stably and efficiently transfer the media 132.

The size of the casing 110 is corresponds to the size of the media 132 to be stored. That is, a length L of the casing 110 corresponds to a length of the media 132, and the width of the casing 110 corresponds to a width of the media 132. Accordingly, if the size of the media 132 decreases, the size of the casing 110 can be miniaturized or otherwise decreased. For example, if the media 132 is a small printing paper as small as a two inch by three and a half inch (2.0"×3.5") business card, the size of the main body 100 may be microminiaturized to correspond to the size of the small printing paper.

The coupling part 113 is provided in one end part of the main body 100 to be rotatably coupled the folding part 200 with the main body 100. The coupling part 113 shares a rotating shaft with the folding part 200 to enable the folding part 200 to rotate with respect to the main body 100. In at least one area of the coupling part 113, a pick-up roller 131 may be provided to feed the media 132, such as paper, of the media storing part 130 to the folding part 200. The pick-up roller 131 provided on the external part has a rubber material with a sufficient friction force to transfer the media 132 of the media storing part 130 to the inside of the folding part 200. The thickness of the pick-up roller 131 may be designed within a variable range sufficient to not interfere when the folding part 200 is rotatably coupled to the main body 100, and may further be provided with a sufficient thickness to pick up the media 132, such as a printing paper of the paper storing part 130.

The inputting part 120 provided on the outside of the casing 110 is supplied with an input signal by a user. The inputting part 120 may be provided in the shape of a plurality of input panels, or a touch screen.

The media storing part 130 is provided in a lower part of the casing 110 to store a plurality of media 132. The media storing part 130 is capable of being opened or closed from the outside of the casing 110 or fixed in the inside of the casing 110. An area contacted with the pick-up roller 131 may be opened to the outside to enable the pick-up roller 131 to contact the media 132 stored therein and apply a frictional force. The area of the media storing part 130 may be sized in relation to the thickness of the main body 100, and further, may have a thickness sufficient to store at least two media 132 so that consecutive outputs can be performed. The media storing part 130 may have a plate and an elastic member disposed to move the plate so that the media 132 stacked on the plate is moved toward and picked-up by the pick-up roller 131 in an opened configuration.

The configuration sensor part 140 provided on one side of the main body 100 detects whether the folding part 200 is in a coupled or closed configuration or an opened configuration from the main body 100 to signal the controller 160 as to the configuration of the main body 100. The configuration sensor part 140 may be provided in partial contact with the main body 100 when the folding part is in the closed configuration. The configuration sensor part 140 may be provided as a pressure sensor or other known sensor having a contact switch or the like. For example, the pressure sensor may determine whether the main body 100 is in an opened or closed configuration based on the pressure applied to the main body 100 when the folding part 200 is in the closed configuration and the lack of pressure applied to the main body 100 when the folding part 200 is in the opened configuration. The configuration sensor part 140 may be a magnet or an optical sensor.

The communication part 150 is provided on an external side of the casing 110 to receive image data from a host H in which the image data is stored. The communication part 150 may be provided as a connector directly connected with the host H or a radio communication part capable of wirelessly communicating by radio. The directly-connected connector may be provided as a USB (universal serial bus) port to be directly connected with a cellular phone, a digital camera, and/or a computer through the connector. The radio communication part may be provided through a radio network such as a Bluetooth or an RFID (Radio Frequency Identification).

The controller 160 controls a media transferring direction according to the result detected by the configuration sensor part 140. If the folding part 200 is in the closed position according to the result detected by the configuration sensor part 140, the controller 160 manually receives a manually-fed media (not illustrated) from external side A and forms an image thereon using a printing unit, for example, a thermal print head (TPH) 221, dispersed in the folding part 200 to print an image on the media 132 and to discharge the media 132 through the main body transferring path 115 of the main body 100 and to an external side B. If the folding part 200 is in the opened configuration according to the result detected by the configuration sensor part 140, the controller 160 controls the folding part 200 to automatically receive the media 132 from the media storing part 130, feeds the media 132 toward the TPH 221 using the pick-up roller 131, and forms an image thereon to discharge the media 132 through a folding transferring path 215 to external side C. The controller 160 applies a driving signal to a driving part (not illustrated) for driving the pick-up roller 131 and enabling the pick-up roller 131 to feed the media 132 of the media storing part 130 to the folding transferring path 215.

After an output signal is applied through the inputting part 120, the controller 160 preheats the TPH 221 of an image forming part 220 in the folding part 200 at a reference temperature to form an image on the media 132, thereby reducing a printing time.

The main body 100 may further comprise a storing part (not illustrated) to store image data received through the communication part 150. The storing part may be built in the main body 100 or provided as a mobile type detachable from the main body 100.

The folding part 200 of the image forming apparatus 1 is provided to rotate between the closed configuration wherein the folding part 200 is coupled to the main body 100 and the opened configuration wherein the folding part 200 is rotatably separated from the main body 100. The folding part 200 forms an image on the manually-fed media introduced within the folding part 200 from external side A in the closed configuration, and forms an image on the media 132 automatically fed from the media storing part 130 in the opened configuration.

The configuration of the folding part 200 may be determined manually by a user and/or automatically by a switch.

The folding part 200 comprises a folding part casing 210 having a paper feeding opening 211*a* through which media 132 is fed, a paper discharging opening 211*b* through which the media 132 is discharged to the outside and the folding transferring path 215 on which the media 132 is transferred, the image forming part 220 for forming an image on the media 132 transferred from the feeding opening 211*a*, and a transferring unit 230 transferring the media 132 on which the image is formed in the image forming part 220 to the outside or the main body transferring path 115 depending on whether the folding part 200 is in the closed configuration or the opened configuration.

The folding transferring path 215 may be provided to correspond to the main body transferring path 115 of the main body 100 in a coupled state to stably transfer the printing paper.

The image forming part 220 forms an image by applying heat to the media 132 having the ink layers realizing different colors of image by heat. The image forming part 220 comprises the TPH 221 applying heat and pressure to the media 132 and a platen 223 provided facing the TPH 221 and pressedly supporting the media 132 with respect to the TPH 221 when the image is formed.

A plurality of minute heating elements are arranged in the TPH 221 to correspond to the width of the media 132 at a predetermined interval. The number of the heating elements may be of a varied number to influence a resolution of the image forming apparatus 1. Since the respective colors of ink layers (Y, M, and C) respond to different temperatures, the respective heating elements are controlled to individually generate heat at different temperatures The TPH 221 is controlled to be preheated at the reference temperature by the controller 160 when the user applies the input signal through the inputting part 120. The reference temperature may be set as a temperature corresponding to the lowest response temperatures among the respective colors of ink layers. Accordingly, the TPH 221 remains in a preheated standby mode at the reference temperature and directly applies heat to form an image if the media 132 enters to reduce an amount of time necessary to form an image.

Figure 3A:
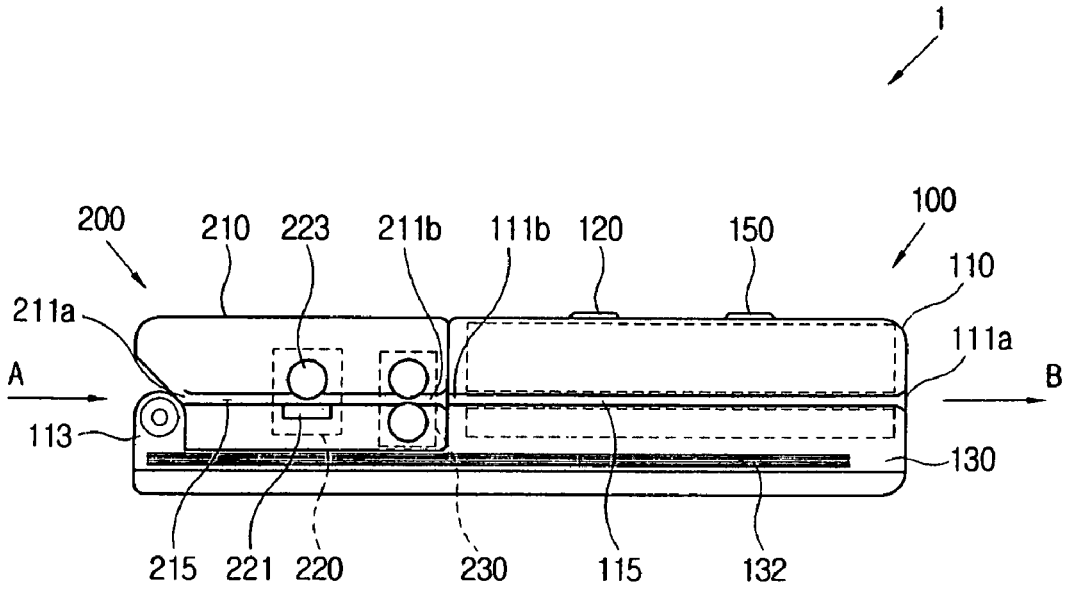
FIGS. 3A and 3B are schematic views illustrating an image forming route in a coupled state and an opened state of an image forming apparatus according to an embodiment of the present general inventive concept.
Figure 3B:
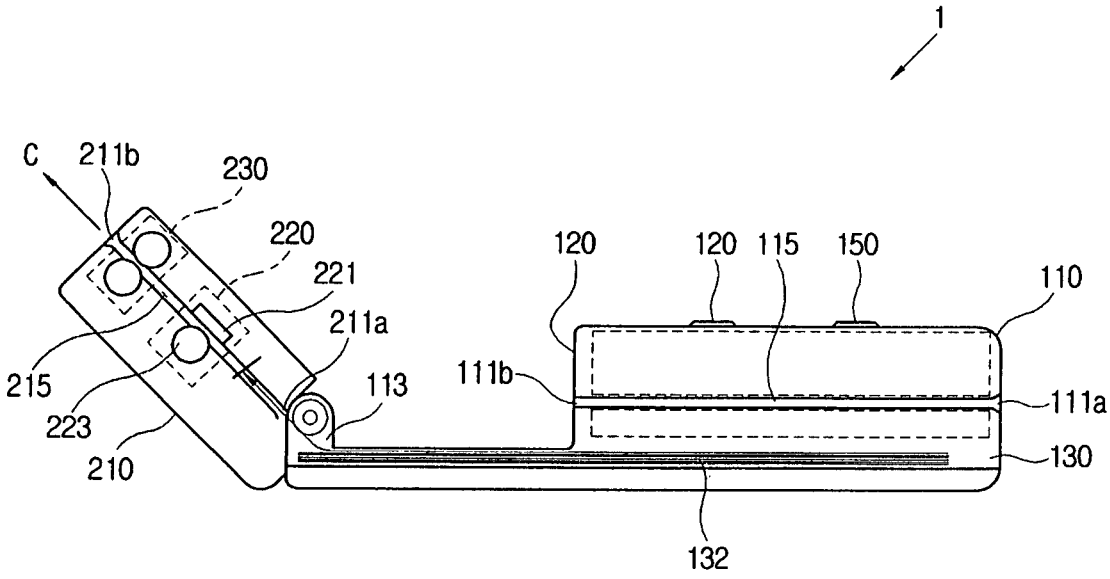

The transferring unit 230 discharges the media 132 on which the image is formed in the image forming part 220. As illustrated in FIG. 3A, if the folding part 200 is in the closed configuration, the transferring unit 230 guides the media 132 having an image formed thereon to the main body transferring path 115 of the main body 100 to discharge it to the outside via external side B. If the folding part 200 is in the opened configuration, the transferring unit 230 directly discharges the media 132 having an image formed thereon to the outside via external side C as illustrated in FIG. 3B.

An image forming process of the image forming apparatus 1 with this configuration will be described by referring to FIGS. 1 to 5.

First, when a user applies an output signal through the inputting part 120 (operation S110), the controller 160 controls the TPH 221 of the image forming part 220 to be preheated at a reference temperature. Accordingly, the respective heating elements remain in the preheated standby mode at the reference temperature (operation S120).

At this time, the communication part 150 of the main body 100 receives the image data from the host H. For instance, if the host H indicates a cellular phone and the communication part 150 communicates by radio, the communication part 150 receives the image data to be inputted through the cellular phone and the radio communication. The received image data is stored in the storing part (not illustrated) (operation S130).

The configuration sensor part 140 detects whether the folding part 200 is in the opened configuration (S140) if the reception of image data completes. In the case that the folding part 200 is coupled to the main body 100, the configuration sensor part 140 informs the controller 160 that the folding part 200 is in the closed configuration, as illustrated in FIG. 3A, thereby allowing the user to insert the manually-fed media via external side A and through the feeding opening 211*a* of the folding part 200. The user inserts the manually-fed media to the inside of the folding part 200 until the manually-fed media engages the transferring unit 230 (operation S160).

The TPH 221 of the image forming part 220 changes the temperatures consecutively from the lowest response temperature among the ink layers of the manually fed media 132 and forms an image corresponding to the image data (operation S161). The media 132 having an image formed thereon is transferred to the main body transferring path 115 through the transferring unit 230 (operation S162), and discharged to the outside (operation S163).

Meanwhile, if the folding part 200 is opened from the main body 100 and in the opened configuration, the controller 160 controls the pick-up roller 131 to rotate and the media 132 of the media storing part 130 to be fed to the feeding opening 211*a* (operation S150). The image forming part 220 applies heat to the media 132 transferred through the folding transferring path 215 to form an image (operation S152). Then, the transferring unit 230 discharges the media 132 having an image formed thereon from the image forming part 220 to the outside via external side C (operation S153).

If a plurality of image data is to be output, the pick-up roller 131 successively supplies the media 132 to the folding part 200, and the image forming part 220 forms images on the media 132. When the image forming completes, the user folds the folding part 200 to be coupled to the main body 100 and in the closed configuration.

Figure 4:
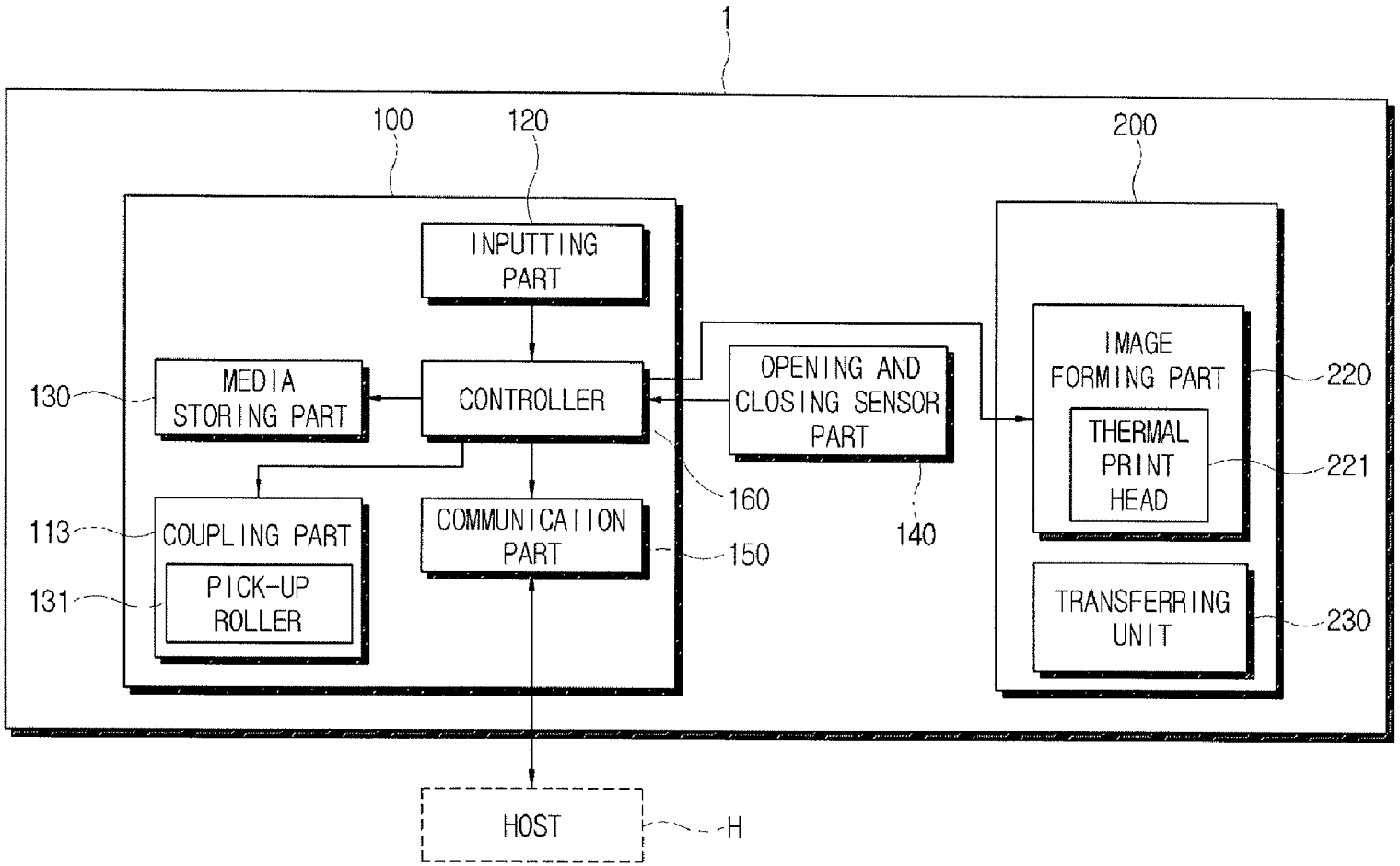
FIG. 4 is a schematic view illustrating a configuration of an image forming apparatus according to an embodiment of the present general inventive concept.
Figure 5:
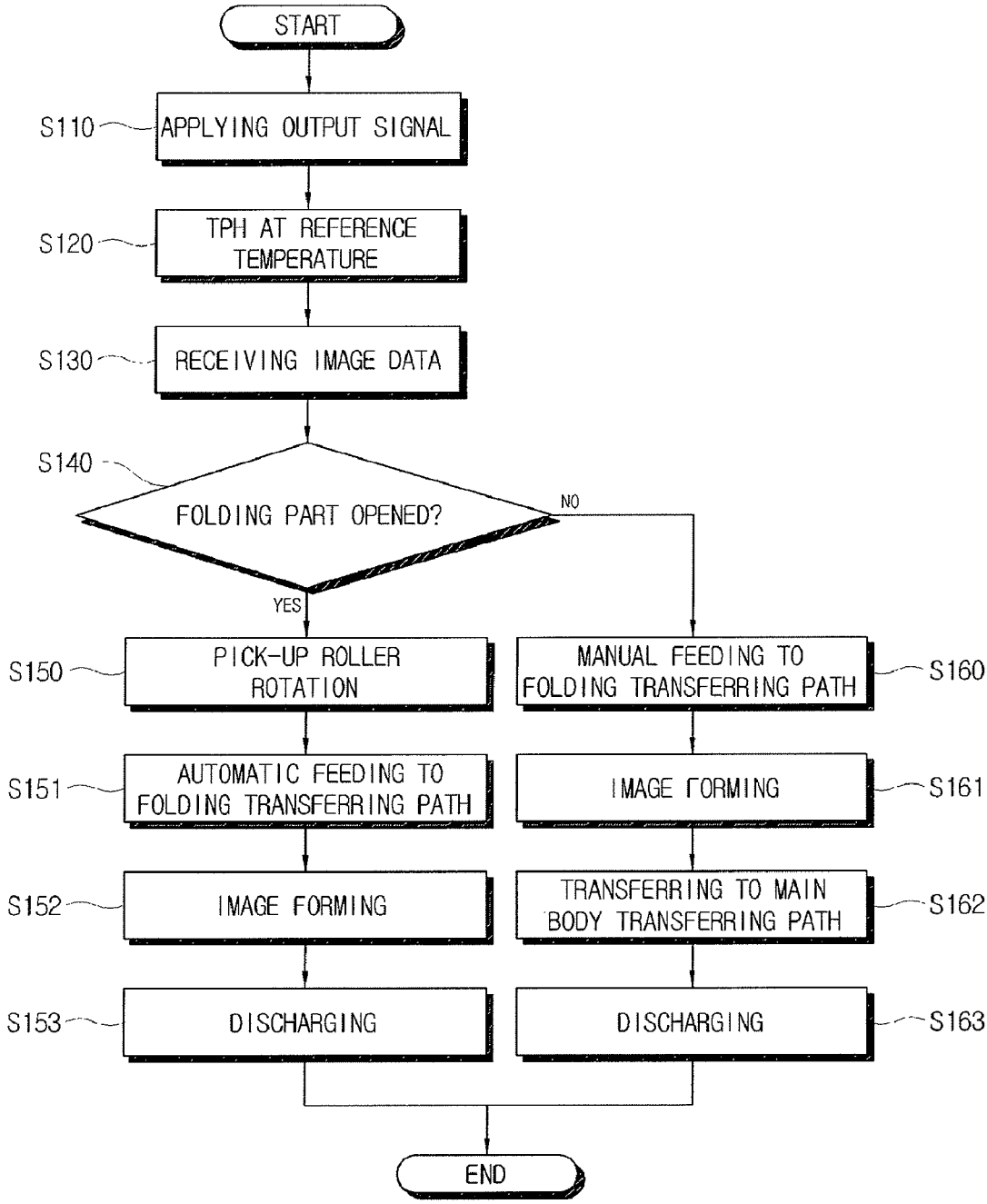
FIG. 5 is a flow diagram illustrating an operation process of an image forming apparatus according to an embodiment of the present general inventive concept.

The image forming apparatus 1 comprises a paper storing part which stores printing papers, thereby automatically feeding the papers. Components of the main body 100 and components of the folding part 200 are connected to each other through a cable (not illustrated). Accordingly, the components illustrated in FIG. 4 are connected to one another to perform operations, including but not limited to pick-up, feeding, printing, and discharging operations.

The user is able to selectively change the folded state from the closed configuration where the folding part 200 is coupled to the main body 100 to the opened configuration where the folding part 200 is opened from the main body 100, thereby automatically controlling the auto feeding and the manual feeding. The auto feeding enables image data to be successively output to thereby enhance the user's convenience.

Since the main body 100 is provided to have a minimum size corresponding to the size of the printing paper, it can be portably used by the user.

The image forming apparatus employs a thermal type to minimize the volume of the main body, but may use a thermal transfer type to apply heat and pressure to the printing paper to coat ink and form an image on the media 132.

In the thermal transfer type, the image forming part 220 of the folding part 200 may further comprise an ink ribbon supply roller (not illustrated) for supplying an ink ribbon and an ink ribbon recycle roller (not illustrated) for recycling the ink ribbon used for the image forming.

The media 132 is supplied either automatically or manually depending on whether the folding part 200 is in the closed configuration and coupled to the main body 100 or in the opened configuration and opened from the main body 100. If the media 132 is supplied automatically, the image data can be successively output.

Also, since the folding part can be folded into the main body to minimize the whole size, it can be portably used by the user.

Although a few exemplary embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A mobile image forming apparatus to form an image on a printing medium, comprising:

a main body comprising a main body transferring path to transfer the medium;

a folding part which is provided to be folded and unfolded with respect to a predetermined rotating shaft rotating between a closed position coupled to the main body and an opened position opened from the main body, and has a folding transferring path to transfer the medium; and an image forming part provided in the folding part, wherein the main body includes a position sensor part to detect when the folding part is in the opened position or in the closed position, a controller to control the transferring path of the medium transferred to the image forming part according to the result detected by the position sensor part, a media storing part to store the medium, and a pick-up roller to pick up the medium stored by the media storing part; and the controller is configured to control the pick-up roller to automatically feed the medium stored in the media storing part to the folding part in the case that the folding part is in the opened position according to the result detected by the position sensor part, and further wherein the main body transferring path and the folding transferring path are communicatively provided in the closed position, such that the medium can be received by the main body from the folding part.

2. The image forming apparatus according to claim 1, wherein the image forming part forms an image on the medium transferred from the media storing part to the folding transferring path when the folding part is in the opened position.

3. The image forming apparatus according to claim 2, wherein the rotating shaft comprises:

a pick-up roller to apply a friction force to the stored medium and feeding the same to the folding transferring path, wherein the rotating shaft is provided in one end part of the media storing part.

4. The image forming apparatus according to claim 2, wherein the folding part comprises:

an opening on one side through which the medium can enter or exit; and a transferring unit to transfer the medium from the image forming part on which the image is formed to the opening provided on the folding transferring path.

5. The image forming apparatus according to claim 4, wherein the image forming part forms an image on the medium manually fed from the opening and transferred to the folding transferring path in the case that the folding part is in the closed position.

6. The image forming apparatus according to claim 5, wherein the transferring unit transfers the medium from the image forming part on which the image is formed to the main body transferring path.

7. The image forming apparatus according to claim 1, wherein when that the folding part is in the closed position according to the result detected by the position sensor part, the controller controls the image forming part to form an image on the medium inputted from the outside through the folding transferring path when an output signal is applied.

8. The image forming apparatus according to claim 7, wherein the folding part provided on one side of the image forming part comprises:

a transferring unit to transfer the medium so that the image-formed medium can be discharged through the main body transferring path.

9. The image forming apparatus according to claim 1, wherein:

the image forming part comprises a thermal print head to apply heat to the medium; and the controller controls the thermal print head to be preset at a reference temperature at which the thermal print head can apply heat to the medium and form an image.

10. The image forming apparatus according to claim 1, wherein the main body comprises a radio communication part to receive image data from a host apparatus.

11. A portable image forming apparatus comprising:

a main body having a media storing part to store a printing medium and further having a path to transfer the printing medium;

a folding part having an image forming part to form an image on the printing medium and further having another path to transfer the printing medium; and a coupling part to couple the main body and the folding part in an opened and closed position and to pick up the printing medium to be fed to form the image, wherein the main body includes a position sensor part to detect when the folding part is in the opened position or in the closed position, a controller to control the transferring path of the medium transferred to the image forming part according to the result detected by the position sensor part, a media storing part to store the medium, and a pick-up roller to pick up the medium stored by the media storing part; and the controller is configured to control the pick-up roller to automatically feed the medium stored in the media storing part to the folding part in the case that the folding part is in the opened position according to the result detected by the position sensor part, and further wherein the path and the another path are communicatively provided in the closed position, such that the medium can be received by the main body from the folding part.

12. The portable image forming apparatus of claim 11, wherein:

the path in the main body comprises one through which the printing medium is fed; and the another path in the folding part comprises one through with the printing medium is fed.

13. The portable image forming apparatus of claim 12, wherein the path and the another path are not connected when the folding part is in the opened position.

14. The portable image forming apparatus of claim 12, wherein the path and the another path form a straight line path in the closed position.

15. The portable image forming apparatus of claim 11, wherein the coupling part comprises a shaft to rotatably couple the main body and the folding part and a pick-up roller having a same rotating axis as the shaft to pick up the printing medium.

16. The portable image forming apparatus of claim 11, wherein the coupling part feeds an externally input printing medium toward the image forming part.

17. The portable image forming apparatus of claim 11, wherein the main body and the folding part form a hexahedral shape in the closed position.

* * * * *